United States Patent [19]

Harvey et al.

[11] Patent Number: 4,925,059

[45] Date of Patent: May 15, 1990

[54] HINGED BOX CONSTRUCTION

[75] Inventors: Thomas J. Harvey, Pawtucket; John D. Kilmartin, III, Providence, both of R.I.

[73] Assignee: International Packaging Corporation, Pawtucket, R.I.

[21] Appl. No.: 326,527

[22] Filed: Mar. 20, 1989

[51] Int. Cl.[5] ..... B65D 43/24

[52] U.S. Cl. ..... 220/335; 220/338; 220/4 E

[58] Field of Search ..... 220/335, 337, 338, 4 B, 220/4 E

[56] References Cited

U.S. PATENT DOCUMENTS

| | | | |
|---|---|---|---|
| 3,152,716 | 10/1964 | Feldhahn | 220/4 E |
| 3,240,375 | 3/1966 | Burrows | 220/335 X |
| 3,272,379 | 9/1966 | Driza et al. | 220/335 |
| 3,295,713 | 1/1967 | Optner | 220/4 E X |
| 3,994,416 | 11/1976 | Mulligan | 220/338 |
| 4,452,373 | 6/1984 | Pearce et al. | 220/335 |
| 4,615,464 | 10/1986 | Byrns | 220/335 X |
| 4,623,071 | 11/1986 | Malcolm | 220/337 |

*Primary Examiner*—Stephen Marcus
*Assistant Examiner*—Nova Stucker
*Attorney, Agent, or Firm*—Salter & Michaelson

[57] ABSTRACT

A box construction includes hingeably connected top and bottom box sections which are preferably of identical configuration and each integrally molded from a plastic material. Each of the top and bottom box sections includes a sidewall portion having a pair of aligned hinge bars thereon and the hinge bars of the top and bottom box sections are received in aligned, pivotable, interfitting engagement to hingeably connect the top and bottom box sections together.

5 Claims, 2 Drawing Sheets

HINGED BOX CONSTRUCTION

BACKGROUND AND SUMMARY OF THE INVENTION

The instant invention relates to display boxes and more particularly to a hinged box construction comprising hingeably connected top and bottom sections which are preferably of identical configuration.

It has generally been found that boxes comprising hingeably connected top and bottom sections can be effectively utilized for storing, transporting, and/or displaying a wide variety of articles, including various jewelry items, writing instruments and gift items. It has been further found that boxes of this general type can often be effectively made in constructions which include hingeably interfitting top and bottom sections which are molded from suitable plastic materials. However, the heretofore available box constructions of this type have generally comprised top and bottom sections having interfitting ball and socket elements along the rear walls thereof in order to hingeably connect the top and bottom sections thereof. It has generally been found that the ball and socket elements of boxes of this type are relatively fragile, and it has been further found that the initial tooling costs associated with manufacturing boxes of this type are often inherently high due to the relatively intricate nature of the ball and socket assemblies thereof.

The instant invention provides an improved box construction of the general type comprising hingeably connected top and bottom sections which overcomes many of the disadvantages of the heretofore available box constructions of this type. Specifically, the box construction of the instant invention comprises a top section including a top wall portion, a depending top sidewall on the top wall and a top hinge portion on the top sidewall portion, and a bottom section including a bottom wall, an upstanding bottom sidewall portion on the bottom wall, and a bottom hinge portion on the bottom sidewall portion. The top and bottom hinge portions are adapted to be assembled as a hinge assembly which includes spaced, substantially aligned first and second top hinge bars on the top sidewall portion and spaced substantially aligned first and second bottom hinge bars on the bottom sidewall portion. The first top hinge bar is received in substantially aligned engagement between the first and second bottom hinge bars and the first bottom hinge bar is received in substantially aligned engagement between the first and second top hinge bars. The hinge assembly further includes a first pair of ball and socket elements on the adjacent ends of the first top hinge bar and the second bottom hinge bar and a second pair of ball and socket elements on the adjacent ends of the first bottom hinge bar and the second top hinge bar, wherein the ball and socket elements cooperate to pivotably retain the first and second top hinge bars in substantially aligned relation with the first and second bottom hinge bars in order to hingeably connect the top and bottom sections together. One end of the first bottom hinge bar preferably engages the adjacent end of the first top hinge bar in order to maintain the socket assemblies in assembled engagement and the second top hinge bar and the second bottom hinge bar preferably define the opposite ends of the hinge assembly. The box construction is preferably constructed so that the top sidewall portion includes a rear top wall which terminates in a lower edge and so that the bottom sidewall portion includes a rear bottom wall which terminates in an upper edge and the top and bottom hinge bars are preferably integrally formed along the lower edge of the top rear wall and along the upper edge of the bottom rear wall, respectively. Further, the top and bottom hinge bars preferably have lower and upper faces, respectively, which are spaced downwardly and upwardly, respectively, from the lower and upper edges, respectively, and rear faces which are spaced rearwardly slightly from the top and bottom rear walls, respectively, and the rear faces of the top and bottom hinge bars are engageable with the upper and lower edges of the bottom and top rear walls, respectively, in order to prevent the top section from being pivoted rearwardly beyond a predetermined angular position wherein it is in substantially perpendicular relation to the bottom section. Still further, the top and bottom sections, including the top and bottom hinge portions thereof, respectively, are preferably of substantially identical configuration and they are preferably each integrally molded from a suitable plastic material.

It has been found that the box construction of the instant invention has significant advantages over the heretofore available boxes of this general type. In particular, the box construction of the instant invention, in its preferred embodiment, can be manufactured with substantially reduced tooling costs because the top and bottom sections are substantially identical. Further, the hinge bars and the ball and socket elements of the top and bottom hinge portions of the box construction are inherently substantially more rugged and durable than the ball and socket assemblies of the heretofore available box constructions. In addition, the hinge bars of the top and bottom hinge portions effectively cooperate to prevent the top section from being pivoted or hinged rearwardly beyond a predetermined angular position wherein it is in substantially perpendicular relation to the bottom section.

Accordingly, it is a primary object of the instant invention to provide an improved box construction comprising hingeably connected top and bottom sections.

Another object of the instant invention is to provide a box construction comprising substantially identical hingeably connected top and bottom sections.

An even further object of the instant invention is to provide an effective box construction which can be manufactured with relatively low initial tooling costs.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
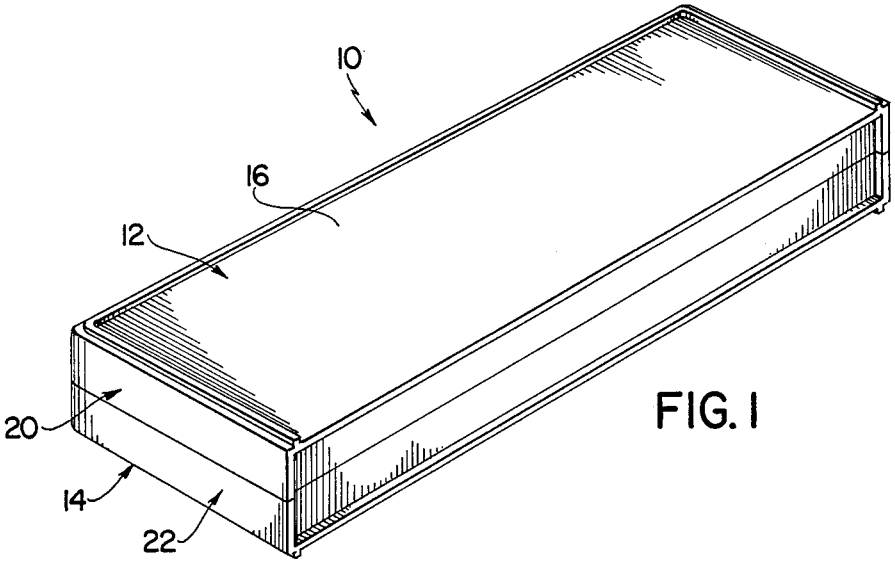
FIG. 1 is a perspective view of the box construction of the instant invention in a closed position.
Figure 2:
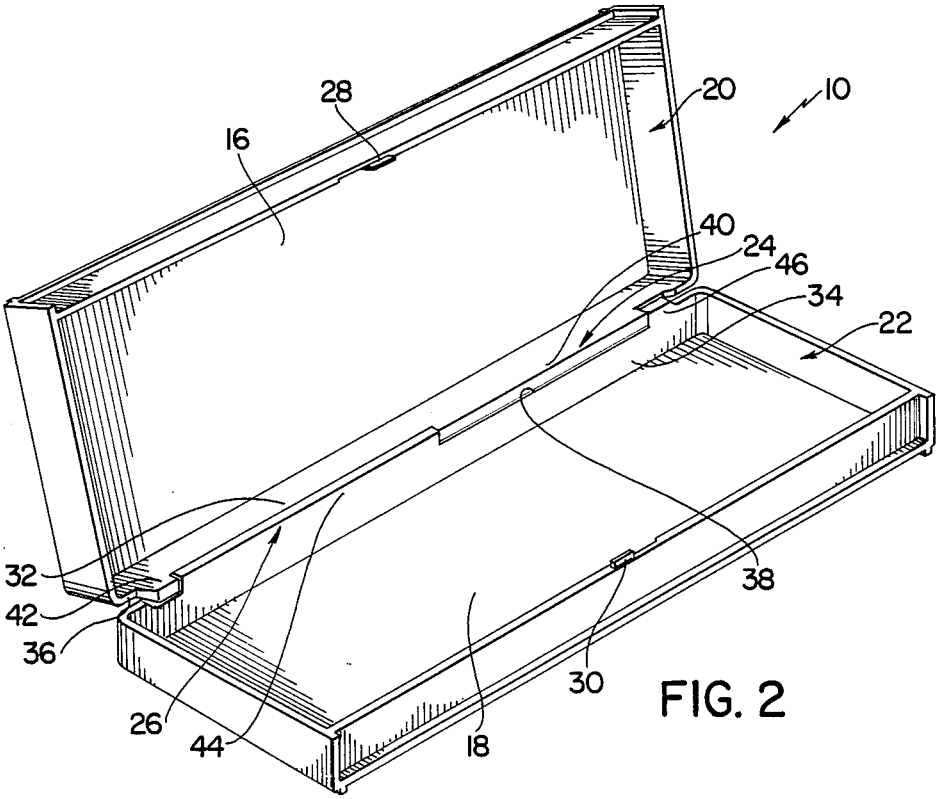
FIG. 2 is a perspective view thereof in an open position.
Figure 5:
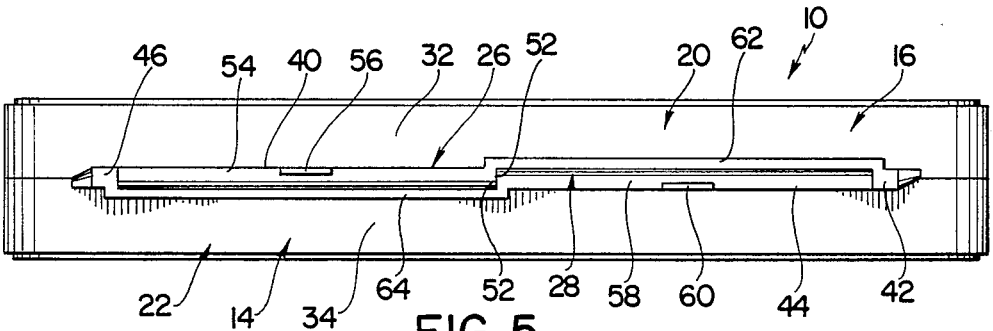
FIG. 5 is a rear elevational view of the box construction.

Referring now to the drawings, the box construction of the instant invention is illustrated and generally indicated at 10 in FIGS. 1, 2 and 5. The box 10 comprises hingeably connected top and bottom box sections generally indicated at 12 and 14, respectively, which are preferably of substantially identical configuration and each integrally molded from a suitable plastic material. The box 10 is constructed so that the top and bottom box sections 12 and 14, respectively, are hingeable between the closed position illustrated in FIGS. 1 and 5 and the open position illustrated in FIG. 2, wherein the top box section 12 is in substantially perpendicular relation to the bottom box section 14.

The top and bottom box sections 12 and 14, respectively, comprise top and bottom walls 16 and 18, respectively, top and bottom sidewall portions generally indicated at 20 and 22, respectively, top and bottom hinge portions generally indicated at 24 and 26, respectively, and top and bottom latch portions 28 and 30, respectively. The top wall 16 is of substantially rectangular configuration and the top sidewall portion 20, which includes a substantially straight rear wall 32, depends from the top wall 16 along the perimeter thereof. The bottom wall 18 is also of substantially rectangular configuration, and the bottom sidewall portion 22 extends upwardly from the bottom wall 18 along the perimeter thereof and includes a substantially straight rear wall 34. The top and bottom rear walls 32 and 34, respectively, terminate in lower and upper edges 36 and 38, respectively, and the top and bottom hinge portions 24 and 26, respectively are formed along the lower and upper edges 36 and 38, respectively. The top and bottom latch portions 28 and 30 are of conventional construction and they include tongues and slots which are snap-receivable in releasable interfitting engagement for releasably retaining the box 10 in the closed position thereof illustrated in FIGS. 1 and 5.

Figure 3:
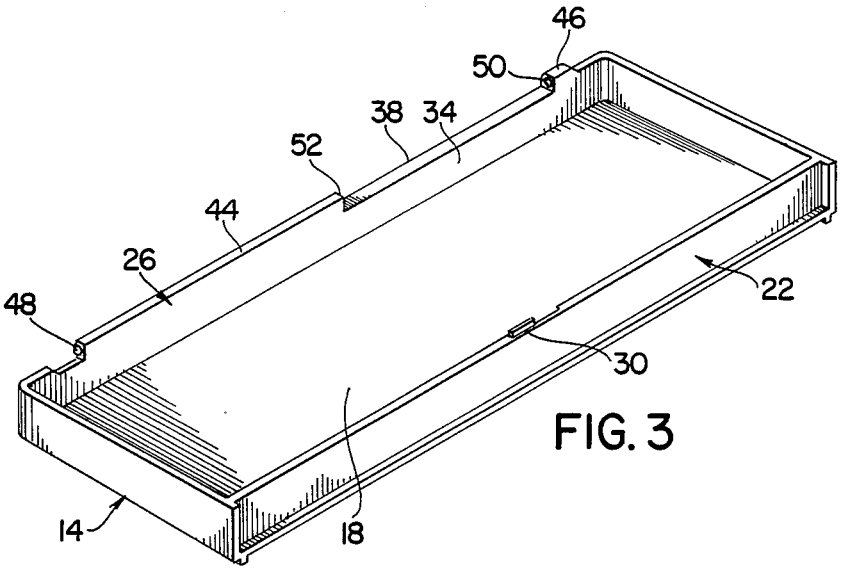
FIG. 3 is a perspective view of the bottom box section.

The top and bottom hinge portions 24 and 26, respectively, are formed along the lower edge 36 and the upper edge 38, respectively, and they are operative for hingeably connecting the top and bottom box sections 12 and 14, respectively, so that they are hingeable between the closed position illustrated in FIGS. 1 and 5, and the open position illustrated in FIG. 2. The top hinge portion 24 includes substantially aligned first and second top hinge bars 40 and 42, respectively, whereas the bottom hinge portion 26 which is preferably substantially identical to the top hinge portion 24 includes substantially aligned first and second bottom hinge bars 44 and 46, respectively. The first top and bottom hinge bars 40 and 44, respectively, are of elongated configuration, and they together extend along approximately 80% of the rear portion of the box 10. The second top and bottom hinge bars 42 and 46, respectively, are of reduced length, and they define the opposite ends of the hinge assembly comprising the top and bottom hinge portions 24 and 26, respectively. The top and bottom hinge portions 24 and 26, respectively, are assembled so that the first and second top hinge bars 40 and 42, respectively, and the first and second bottom hinge bars 44 and 46, respectively, are in substantially aligned relation with the first top hinge bar 40 received in engagement between the first and second bottom hinge bars 40 and 46, respectively, and the first bottom hinge bar 44 received in engagement between the first and second top hinge bars 40 and 42, respectively. Also included in the assembly comprising the top and bottom hinge portions 24 and 26, respectively, is a pair of ball and socket assemblies, each comprising a ball element 48 and a socket 50 (see FIGS. 3 and 4). The ball elements 48 are formed on the outwardly facing ends of the first top and bottom hinge bars 40 and 44, respectively, whereas the sockets 50 are formed on the inwardly facing ends of the second top and bottom hinge bars 42 and 46, respectively, although it will be understood that the relative positions of the ball elements 48 and the sockets 50 could be reversed. The ball elements 48 and the sockets 50 cooperate to hingeably retain the hinge portions 24 and 26 in substantially aligned relation and the top and bottom first hinge bars 40 and 44, respectively, preferably include substantially flat inner ends 52 which engage one another to maintain the ball elements 48 in engagement in their respective sockets 50. In this regard, the ends 52 are preferably substantially flat and hence the first hinge bars 40 and 44 are freely rotatable relative to each other with the ends 52 thereof in engagement in order to maintain the ball elements 48 in rotatable engagement in their respective sockets 50.

Figure 4:
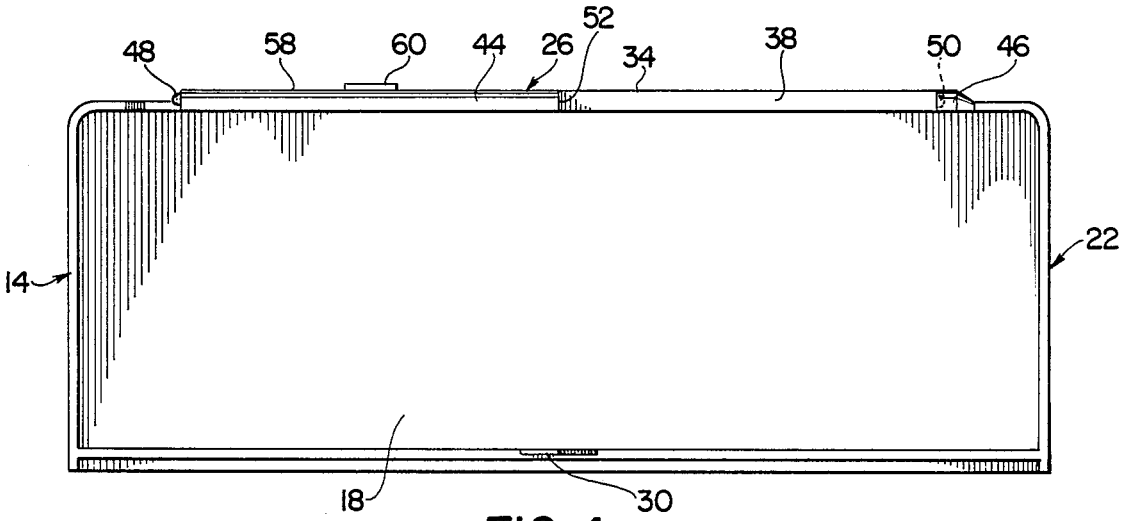
FIG. 4 is a top plan view of the bottom box section.

Referring to FIGS. 4 and 5, it will be seen that the first top hinge bar 40 includes a rear face 54 having a stop element 56 thereon which is spaced rearwardly slightly from the top rear wall 32 and it will be further seen that the first bottom hinge bar 44 includes a rear face 58 having a stop element 60 thereon which is spaced rearwardly slightly from the bottom rear wall 34. In addition, it will be seen that the top box section 12 includes a rearwardly projecting lip 62 which extends along a portion of the lower edge 36 of the top rear wall 32 and that the bottom box section 14 includes a rearwardly projecting lip 64 which extends along a portion of the upper edge 38 of the bottom rear wall 34. The rear faces 54 and 58 and the stop elements 56 and 60 thereon are positioned so that when the box 10 is in the fully open position illustrated in FIG. 2, the stop element 56 engages the upper edge 38 along the rear lip 64 of the bottom rear wall 34 and the stop element 60 engages the lower edge 36 along the rear lip 62 of the top rear wall 32 in order to prevent the top box section 12 from being hinged openly beyond a position wherein it is in substantially perpendicular relation with respect to the bottom box section 14.

It is seen therefore that the box construction of the instant invention represents a significant improvement over the heretofore available box constructions. In this regard, because the top and bottom sections 12 and 14 are preferably of substantially identical configuration, they can both be made from a single mold so that the tooling costs required to manufacture the box 10 can be minimized. Further, because of the relatively simple, yet inherently rugged constructions of the first hinge bars 40 and 44 and the second hinge bars 42 and 46, the hinge portions 24 and 26 cooperate to provide an effective and durable hinge assembly for hingeably connecting the top and bottom sections 12 and 14, respectively. Still further, because of the manner in which the first hinge bars 40 and 44 are engageable with the edges 38 and 36, respectively, the hinge assembly comprising the top and bottom hinge portions 24 and 26 is effectively able to prevent the top box section 12 from being pivoted rearwardly with respect to the bottom box section 14 beyond a predetermined angular position. Accordingly, for these reasons as well as the other reasons hereinabove set forth, it is seen that the instant invention represents a significant advancement in the packaging art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A box construction comprising hingeably connected top and bottom sections, said top section including a top wall and a depending top sidewall portion on said top wall, said bottom section including a bottom wall and an upstanding bottom sidewall portion said bottom wall, and a hinge assembly including top and bottom hinge portions attached to said top and bottom sidewall portions, respectively, for hingeably connecting said top and bottom sections, said top hinge portion including spaced, substantially aligned first and second top hinge bars, said bottom hinge portion including spaced substantially aligned first and second bottom hinge bars, said first and second top hinge bars and said first and second bottom hinge bars each having opposite ends, said first top hinge bar being received in substantially aligned engagement between said first and second bottom hinge bars, said first bottom hinge bar being received in substantially aligned engagement between said first and second top hinge bars, first ball and socket means pivotably connecting an end of said first top hinge bar to an end of said second bottom hinge bar and second ball and socket means pivotably connecting an end of said first bottom hinge bar to an end of said second top hinge bar, said first and second ball and socket means cooperating to pivotably retain said first and second top hinge bars in substantially aligned relation with said first and second bottom hinge bars in order to hingeably connect said top and bottom sections together, said too sidewall portion terminating in a lower edge, said bottom sidewall portion terminating in an upper edge, said first and second top hinge bars being mounted on said lower edge, said first and second bottom hinge bars being mounted on said upper edge, said first top and bottom hinge bars being engageable with said lower and upper edges, respectively, to prevent said top section from being pivoted beyond a predetermined angular position relative to said bottom section.

2. In the box construction of claim 1, said top section being approximately perpendicular to said bottom section when said top and bottom sections are in said predetermined angular position.

3. In the box construction of claim 1, said first top and bottom hinge bars having rear faces which are spaced rearwardly slightly from said top and bottom sidewall portions, respectively, said rear faces of said first top and bottom hinge bars being engageable with said lower and upper edges, respectively, to prevent said top section from being pivoted beyond said predetermined angular position relative to said bottom section.

4. In the box construction of claim 3, said top and bottom sections being of substantially identical configuration.

5. In the box construction of claim 4, said top and bottom sections each being integrally molded from a plastic material.

* * * * *